US007841447B2

(12) United States Patent
Frame

(10) Patent No.: US 7,841,447 B2
(45) Date of Patent: Nov. 30, 2010

(54) LADDER WITH REMOVABLE STEP AND METHOD OF STORING THE LADDER IN A COMPACT CONTAINER

(75) Inventor: William F. Frame, Hockessin, DE (US)

(73) Assignee: Ballymore Company, Inc., West Chester, PA (US)

( * ) Notice: Subject to any disclaimer, the term of this patent is extended or adjusted under 35 U.S.C. 154(b) by 592 days.

(21) Appl. No.: 11/746,989

(22) Filed: May 10, 2007

(65) Prior Publication Data

US 2008/0073149 A1 Mar. 27, 2008

Related U.S. Application Data

(60) Provisional application No. 60/825,190, filed on Sep. 11, 2006.

(51) Int. Cl.
*B66F 11/04* (2006.01)

(52) U.S. Cl. ..... 182/16; 182/15; 182/17

(58) Field of Classification Search ..... 182/15, 182/17, 1, 20, 152, 156, 162, 127
See application file for complete search history.

(56) References Cited

U.S. PATENT DOCUMENTS 1,820,315 A * 8/1931 Miller ..... 182/122
2,444,096 A 6/1948 Faust
3,020,972 A 2/1962 Hockett
3,059,722 A * 10/1962 Rouse ..... 182/33
3,115,214 A 12/1963 Roberts
3,130,814 A 4/1964 Del Aquila
3,490,558 A 1/1970 Foley
3,637,046 A 1/1972 Emmons
D248,290 S * 6/1978 Guerette ..... D34/30
4,440,264 A * 4/1984 Knoke et al. ..... 182/126
4,457,398 A 7/1984 Loix
5,056,620 A 10/1991 Zumwalt et al.
5,460,241 A 10/1995 LaBelle
5,762,163 A * 6/1998 Kain ..... 182/161
6,443,260 B1 * 9/2002 Katz et al. ..... 182/129
6,450,290 B1 * 9/2002 Spak ..... 182/165

(Continued)

OTHER PUBLICATIONS

International Searching Authority, International Search Report and Written Opinion, Apr. 15, 2008.

*Primary Examiner*—Katherine W Mitchell
*Assistant Examiner*—Candace L. Bradford
(74) *Attorney, Agent, or Firm*—Rudoler & DeRosa LLC

(57) ABSTRACT

A modular ladder comprises a base having a back end and a front end. A vertical support is attachable to the back end of the base. The ladder also includes a stair section assembly comprising a plurality of steps. The stair section assembly has a front end and a back end. The front end of the stair section assembly is attachable to the front end of the base. The back end of the stair section assembly is attachable to the vertical support. The stair section assembly comprises a separate top step, whereby the top step is capable of being attached to the stair section and whereby the attachable nature of separate top step facilitates storing the ladder in a compact container which is smaller than the stair section and top step when placed in an assembled condition. A method of storing the ladder in a compact container is also disclosed.

2 Claims, 5 Drawing Sheets

U.S. PATENT DOCUMENTS 6,637,549 B1 10/2003 Lopacki
6,786,300 B1 * 9/2004 Bonifacini ..... 182/120
6,951,265 B2 * 10/2005 Frame et al. ..... 182/152
7,182,176 B2 * 2/2007 Gibson et al. ..... 182/129
2003/0209385 A1 * 11/2003 Kuehl et al. ..... 182/17
2005/0029048 A1 * 2/2005 Frame et al. ..... 182/152
2005/0051940 A1 3/2005 Bensman

* cited by examiner

LADDER WITH REMOVABLE STEP AND METHOD OF STORING THE LADDER IN A COMPACT CONTAINER

CROSS-REFERENCE TO RELATED APPLICATIONS

The present application claims the benefit of U.S. Provisional Application No. 60/825,190 filed on Sep. 11, 2006, which is incorporated herein by reference.

STATEMENT REGARDING FEDERALLY SPONSORED RESEARCH OR DEVELOPMENT

The present invention was not developed with the use of any Federal Funds, but was developed independently by the inventor.

BACKGROUND OF THE INVENTION

The invention relates to a ladder having a separate top step that enables the ladder to be packaged in a compact unassembled form that facilitates efficient shipping and transportation in a container. The invention also relates to a method of storing the ladder in a compact container.

There has been a long standing problem in the ladder industry that rolling ladders are difficult to package arid ship. They are built to rigorous industry safety standards that are specified in ANSI 14.7. Rolling ladders typically consist of a welded stair section. Typically the top step of the ladder is substantially deeper in depth than the lower steps. This deeper step allows a larger platform for a user to stand on.

Unfortunately the deeper step makes rolling ladders more cumbersome to package and ship. While the support frames, hand rails and wheels of the ladder may be easily removed for shipping, the deeper top step still protrudes up when the welded stair section is laid flat (see FIG. 4). This increases the shipping container size and makes the boxes difficult to stack for shipping.

Although rolling ladders have been available in the market for many years, the problem of a ladder configuration that will allow for a more compact shipping container has not be solved.

SUMMARY OF THE INVENTION

A modular ladder comprises a base having a hack end and a front end. A vertical support is attachable to the back end of the base. The ladder also includes a stair section assembly comprising a plurality of steps. The stair section assembly has a front end and a back end. The front end of the stair section assembly is attachable to the front end of the base. The back end of the stair section assembly is attachable to the vertical support. The stair section assembly comprises a separate top step, whereby the top step is capable of being attached to the stair section and whereby the attachable nature of separate top step facilitates storing the ladder in a compact container which is smaller than the stair section and top step when placed in an assembled condition. Preferably, the stair section assembly is substantially a one piece assembly and the separate top step is attachable to the stair section assembly.

In one preferred form of the invention the top step is deeper than the remaining steps of the stair section.

In a preferred embodiment wheels or casters are attached to the base.

In another preferred form of the invention the stair section comprises a mount attached to each side of the stair section for mounting the top step to the stair section. A fastener may attach the top step to the mount. The top step may be removably attached to the stair section using the fastener or may be fixedly attached to the stair section. In one form of the invention the stair section may comprise a pair of side rails with the mounts being attached to the side rails for accepting the top step.

The mount may comprise a bracket having a substantially L-shaped configuration. The bracket may have a vertical leg and a horizontal leg. The vertical leg is attached to the side of the stair section and the horizontal leg has an upper face in cooperative engagement with the bottom face of the top step.

In one form of the invention the vertical support attaches to the top step. The ladder may also include hand rails attached to the stair section for protecting an end user. The ladder may also include a lockstep attached to a bottom step of the ladder assembly.

The invention also includes a method for storing the modular ladder in a compact container. The method comprises the steps of providing the modular ladder, providing a compact container which is smaller than the stair section and top step when placed in an assembled condition, and packing the base, stair section assembly, and the top step in an unassembled condition in the compact container.

Some of the advantages of the ladder of the present invention include that the ladder is a standard rolling ladder with a broad range of configurations and slopes. The top step of the ladder is a separate component from the remainder of the stair section assembly which allows the ladder to be packaged flat in a corrugated box, or other packaging material which dramatically reduces the freight cost. The separate top step further provides the opportunity to stack ladders on the shipping vehicle, such as a truck, further reducing freight cost. The removable top step also reduces the risk of freight damage. The separate top step allows more ladders to fit in a truck or container, creating the ability to have the ladders manufactured in a lower cost area and imported for sale into various markets.

DETAILED DESCRIPTION OF THE INVENTION

Figure 1:
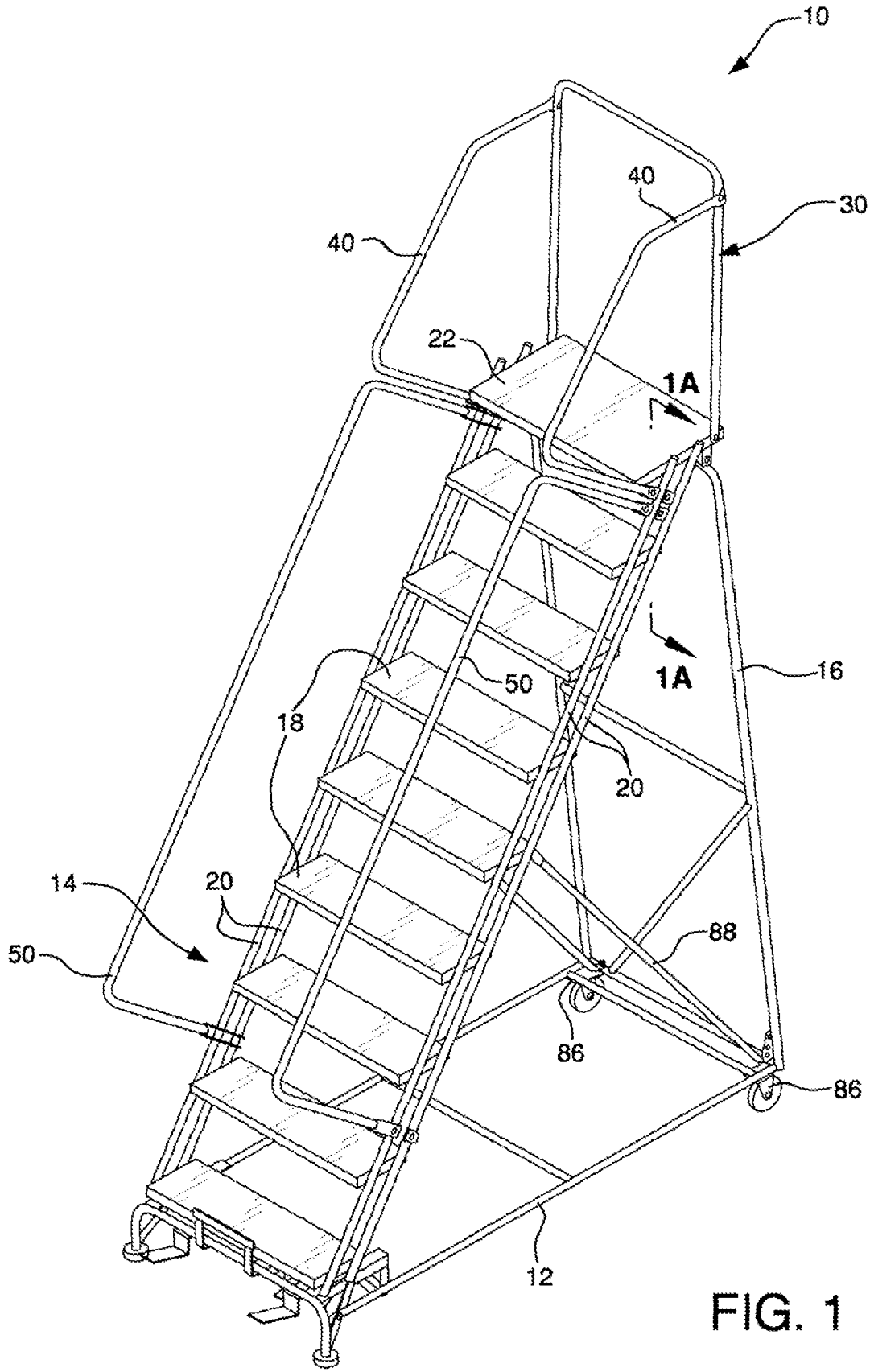
In FIG. 1 there is shown a perspective view of one preferred form of the ladder of the present invention when assembled.

In FIG. 1 there is shown a preferred embodiment of a rolling ladder 10 in accordance with the present invention. The ladder 10 has a modular design which facilitates disassembly for shipping in compact containers, yet which can be easily assembled by an end user. Preferably, the ladder 10 is manufactured in accordance with ANSI 14.7

Figure 4:
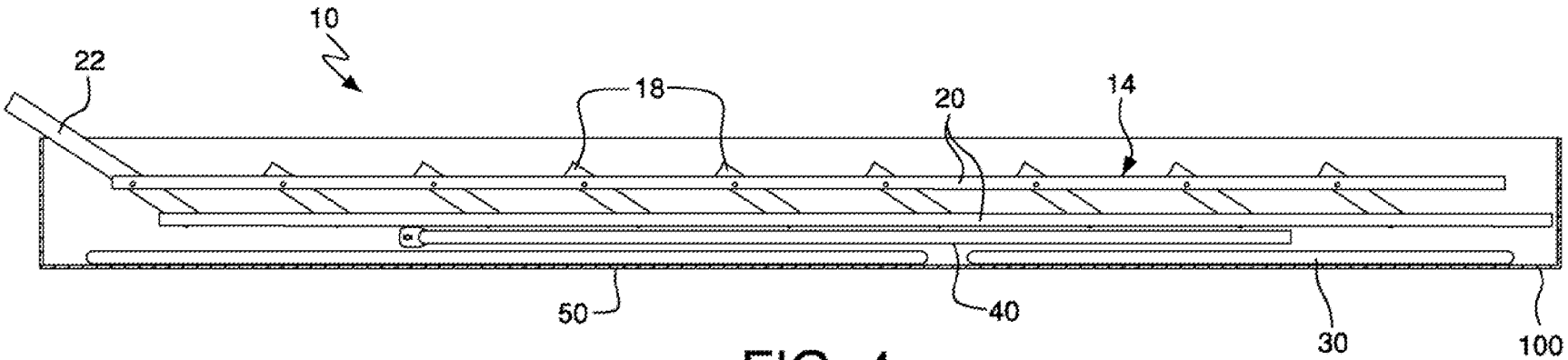
In FIG. 4 there is shown a side view of the ladder of FIG. 1 disassembled and placed into a storage or shipping container, with the top step still attached to the stair section.
Figure 5:
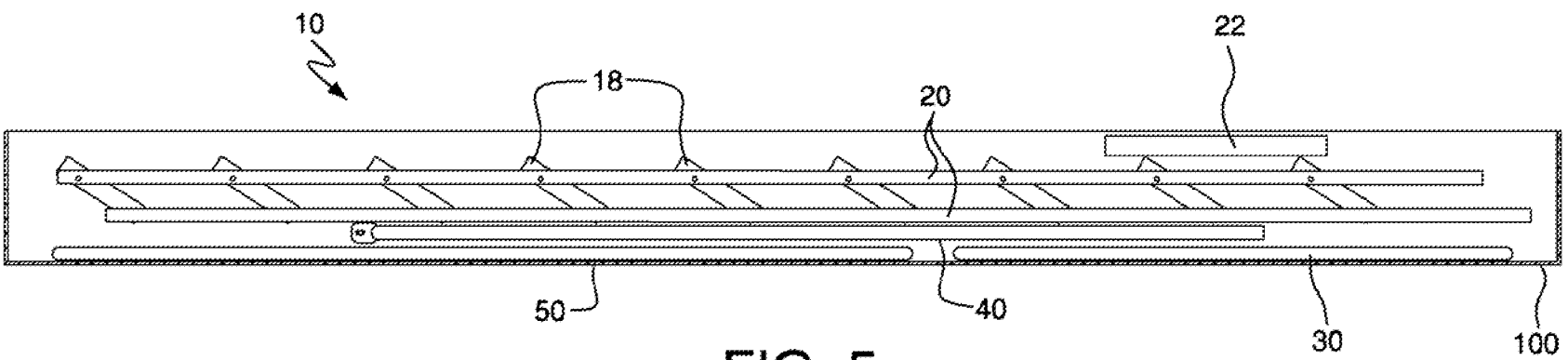
In FIG. 5 there is shown a side view of the ladder of FIG. 1 disassembled and placed into a storage or shipping container, with the top step removed from the stair section.

In particular, as best seen in FIG. 5, the top step 22 designed to be a separate component from the remainder of the stair tread section 14 to facilitate placing the stair step section 14 and the remainder of the unassembled ladder in a compact shipping container 100. Due to the large relative size of the top step 22, if the top step 22 were attached during shipping as shown in FIG. 4 the size of the shipping container 100 would have to be greatly increased in height in order to cover the extended top step. Being able to ship the ladder 10 in a more compact shipping container 100, as shown in FIG. 5, increases the amount of ladders which can be fit into a standard cargo container.

Returning to FIG. 1, the ladder 10 comprises a base 12, a stair section 14 attached at its bottom end to the front end of the base. A vertical support 16 connects the top end of the stair section 14 (via the top step 22) to the back end of the base 12.

The stair section 14 includes a plurality of treads 18 attached to a pair of end rails or stringers 20 forming the stair section. Treads are also referred to herein as stairs or steps. The stair section 14 preferably has an elongated parallelogram shape. Preferably, the stair section 14 comprises a substantially one-piece assembly. Preferably, the treads 18 are fixedly attached to the stringers 20 via any suitable means, such as by welding, riveting or the like. However, in an alternative embodiment some of these treads 18 may be removable as well.

Figure 1A:
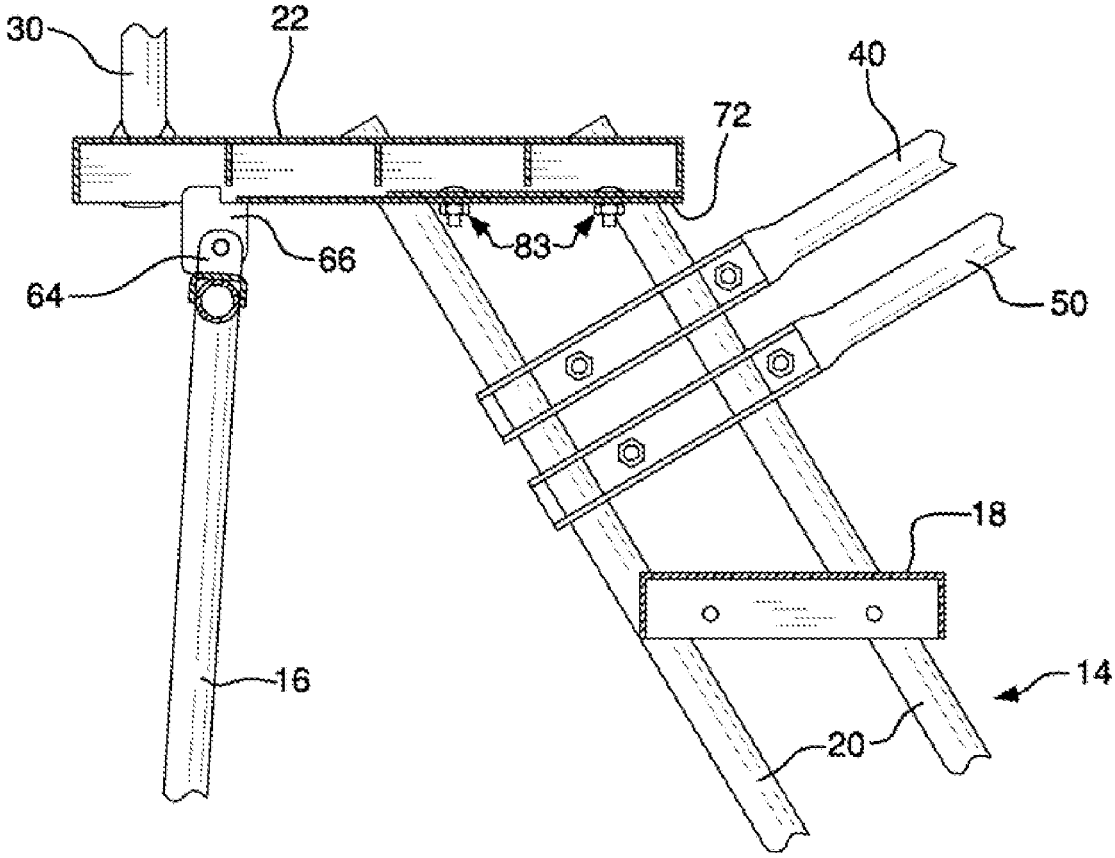
Figure 2:
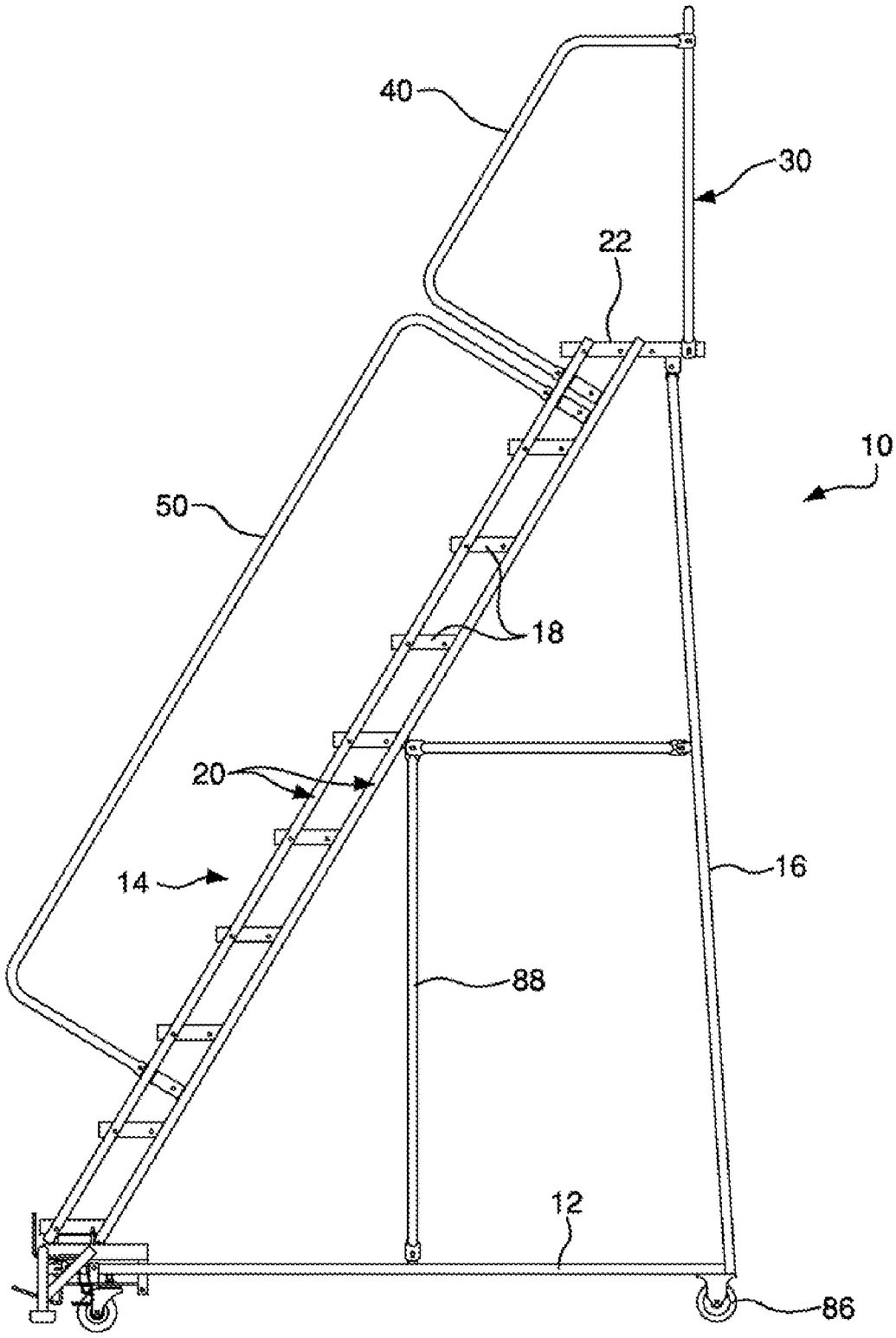
In FIG. 2 there is shown a side view of the top of the ladder of FIG. 1.

With reference to FIG. 1A, the top step or tread 22 is removably attached to the top end of the end stringers 20 using suitable fasteners 83, such as locknuts and washers, as described in greater detail below. The depth of the top step 22 may be deeper than the remaining steps or treads 18 to facilitate the standing or supporting of an end user or other material to be supported. Typically, the depth of the top step 22 is in the range of about 100% to 300% deeper than the treads 18.

The ladder 10 may also include top side handrails 40 and a rear guardrail 30. The top handrails 40, the rear guardrail 30, and stair section 14 are attached to each other using suitable fasteners, such as bolts, washers, and locknuts. Lower handrails 50 may be attached to the stringer stair section via the brackets and using suitable fasteners, such as bolts and locknuts.

As best seen in FIGS. 1 and 1A, the vertical support frame 16 includes a pair of brackets 64 extending upwardly. The brackets are for attaching the back of the top step 20 to a pair of tabs 66 protruding from the bottom of the top step 22. The vertical support frame 16 is fastened to the top step 22 with suitable fasteners 70, such as bolts, washers, and locknuts. Of course it should be understood that the stair section 14 may be attached to the vertical support 16 in many other suitable ways so long as the vertical support 16 provides stability and support to the stair section 14. FIG. 1A also shows how in a preferred embodiment the lower rails 50, upper rails 40 and stringers 20 may be attached.

Figure 3:
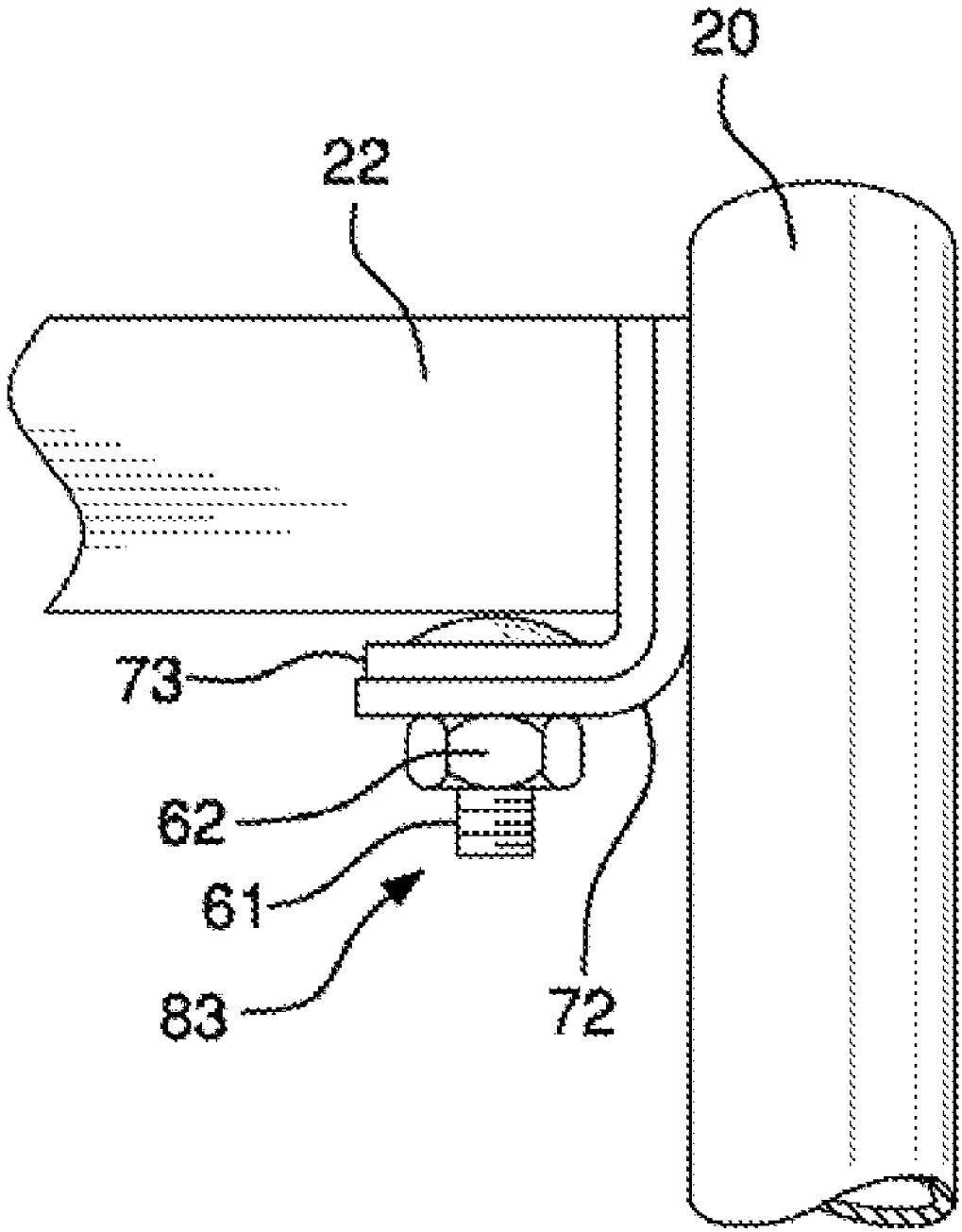
In FIG. 3 there is shown a view of the attachment hardware for attaching the removable step to the stair section.

Referring now to FIG. 3, the attachment of the top step 22 to the side stringers 20 is shown (only one stinger shown). A mount 72, such as an L-shaped bracket, is attached to the inside of each stringer 20 forming a shelf for the attachment of the top step 22 thereto. Preferably, this mount 72 is welded to the stringer 20 or stair section 14. The top step 22 fits within the mount 72 with the bottom face or surface of the top step 22 resting on the top face or surface of the horizontally disposed leg of the bracket 72. The top step 22 is attached to the bracket 72 using suitable fasteners 83, such as bolts 61 and lockouts 62. The top step 22 may have a complementary mount 73, such as an L-shape bracket, welded to it, through which the fastening hardware 83 can be attached. This prevents the top step from lifting up. Alternatively, the step may have appropriate place holes (not shown) to receive the fastening hardware 83 directly.

Casters 86 may also be attached to each side of the vertical support frame 16 or base 12 to facilitate the mobility of the ladder 10. The term casters as used herein includes casters, wheels, balls or any other rolling device.

Diagonal braces 88 may be include to further stabilize and support the stair assembly 14 in use. The braces 88 are fastened to the ladder body using suitable fasteners, such as bolts, washers, and locknuts. The particular details given regarding handrails 50, 40, guardrails 30, supports 16, 88, casters 86 and base 12 and their attachment, while used in a preferred embodiment of the invention are included by way of example and are not meant to in any way limit the scope of the invention.

Referring to FIG. 4, if the guard rails 30, 40 and 50 and support structure are disassembled from the stair section 14, the stair section 14 can be laid flat into the container 100. However, with the upper step 22 still attached to the stair section 14 it can be readily seen that the upper is step significantly higher than the remaining treads 18 and thus the container 100 is not deep enough to cover the upper step 22. In prior art embodiments this problem was solved by making the container, usually a corrugated cardboard box, deeper (i.e. higher). This is less than optimal because it results in a larger container. Also, with a larger container, the container is easily crushed if a second unit is placed on top, since there is empty space above the ordinary sized stairs 18. The height of the removable step 22 when it is in the position shown in FIG. 5 is referred to herein in as the depth of the removable step in the attached position.

Referring to FIG. 5, the larger top step 22 is removed and can be placed in a convenient position. The inventor has found the position shown in FIG. 5 to be convenient for the removable step 22, but any position within the container may be used. The additional hardware of the rolling ladder such as fasteners, casters 86 and rails, shown representatively by the handrail 30, 40 and guard rail 40 may also be stored within the container, or shipped separately.

While in the preferred embodiments described herein the ladder is a rolling ladder, the invention applies equally to any stationary ladders. Likewise, while the stair section has been described as having the steps/treads welded or riveted in place, these lower steps may be held in place through any convenient method (bolts, etc.) or made of a single piece of metal. Likewise these lower treads may also be removable and be within the scope of the invention.

Similarly, ladders with additional steps/treads above the removable step are also within the scope of the claimed invention, even though the removable step is often described as the "upper" or "top" step herein.

In the preferred embodiment the entire ladder assembly, or a substantial portion thereof, is made out of metal, preferably steel or stainless steel.

It should also be noted that it may be possible after the ladder has been shipped to assemble the ladder in a manner that the removable ladder is no longer removable (such as through soldering, riveting or attachment hardware that cannot be removed). So long as such ladder can be originally stored and shipped with the removable step apart from the stair assembly, it would be considered a "removable step."

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method of storing or transporting a ladder in a compact container comprising the steps of:

providing a modular ladder having an assembled configuration that comprises; a base having a front end and a back end, a vertical support attached to the back end of the base when the ladder is in the assembled configuration, a stair section assembly comprising a plurality of steps connected between two parallel stringer sections, the stair section assembly having a front end and a back end, the front end of the stair section assembly being attached to the front end of the base when the ladder is in the assembled configuration, the stair section assembly further comprising a removable top step with a depth dimension perpendicular to the vertical support when the ladder is in the assembled configuration, the removable top step directly attached to the vertical support and the stair section when the ladder is in the assembled configuration; providing a compact container that has a depth smaller than the depth of the removable step in the assembled configuration; packing the stair section assembly and the removed top step in the compact container such that the plurality of steps remain assembled between the stringer sections.

2. The method of claim 1 further comprising the step of permanently attaching the removable step to the stair section after the ladder is shipped to a distributor or customer.

* * * * *